US005683276A

United States Patent [19]

Jordan

[11] Patent Number: 5,683,276

[45] Date of Patent: Nov. 4, 1997

[54] MARINE JET PROPULSION INLET DUCT AND METHOD

[76] Inventor: Jeff P. Jordan, 3061 69th Ave. SE., Mercer Island, Wash. 98040

[21] Appl. No.: 600,684

[22] Filed: Feb. 13, 1996

[51] Int. Cl.[6] ..... B63H 11/04

[52] U.S. Cl. ..... 440/38; 440/47

[58] Field of Search ..... 440/38, 46, 47; 60/221, 222

[56] References Cited

U.S. PATENT DOCUMENTS

| | | | |
|---|---|---|---|
| 3,942,463 | 3/1976 | Johnson, Jr. et al. | 440/47 |
| 4,775,341 | 10/1988 | Tyler et al. | 440/38 |
| 5,244,425 | 9/1993 | Tasaki et al. | 440/47 |
| 5,324,216 | 6/1994 | Toyohara et al. | 440/47 |
| 5,338,234 | 8/1994 | Nanami | 440/38 |
| 5,401,198 | 3/1995 | Toyohara et al. | 440/47 |

*Primary Examiner*—Jesus D. Sotelo
*Attorney, Agent, or Firm*—Robert M. Storwick

[57] ABSTRACT

An improved inlet duct for a marine jet propulsion system is disclosed designed to allow the overall system to operate more efficiently. The inlet duct includes a hydraulically efficient inlet tunnel with a forward entrance opening integrally formed on the bottom of the hull of the watercraft, and a rear exit opening formed inside the hull of the watercraft adjacent to the pump. The inlet tunnel is longitudinally aligned and gently curves upward inside said hull following streamlines of generation and has cross-sectional area that progressively increases from the fore to the aft positions therein. Disposed over the front entrance opening of the inlet tunnel is an articulating structure designed to adjust its size according to the difference in hydraulic conditions that exist inside the inlet tunnel and the outside of the hull so that the velocity of the incoming water matches the velocity of the watercraft in the body of water. By using the improved inlet duct, the total dynamic head of the incoming water can be recovered by the pump which is especially desirable when the combination of a large pump and a large, adjustable discharge nozzle are used which can handle a greater flow of water and maintain efficient hydraulic conditions on the pump.

11 Claims, 6 Drawing Sheets

MARINE JET PROPULSION INLET DUCT AND METHOD

BACKGROUND OF THE INVENTION

1. Field of the Invention

This invention relates to inlet ducts, and, more particularly, to improved inlet ducts for marine jet propulsion systems.

2. Description of the Related Art

A typical marine jet propulsion system includes an inlet duct, a pumping means, and a nozzle. The inlet duct delivers water from under the hull to a low volume, high speed pumping means which is coupled to a gasoline powered, internal combustible engine. The pumping means forcibly delivers the water delivered through the inlet duct to a discharge nozzle which propels the watercraft through the body of water in which the watercraft moves.

Heretofore, high revolution, gasoline powered engines have been used in marine jet propulsion systems due to their lower costs, the availability of a wide variety of different horsepowers, their ability to be directly connected to a pumping means and to provide sufficient high RPM required by the pumping means. Due to the relatively high RPM produced by these engines, high speed pumping means are commonly used in such systems. Unfortunately, these high speed pumping means operate most efficiently when a small volume of water under relatively high pressure is delivered therethrough. Because only a relatively small amount of water is required by these pumping means, watercraft manufacturers, heretofore, have not been concerned with the size or the efficiencies of the inlet duct.

One goal of these manufacturers is to develop jet propulsion systems which are more efficient and provide improved performance and fuel economy. Heretofore, it has been generally accepted that the highest propulsion efficiency for a jet propulsion system is achieved when a large mass of water is accelerated a very small increment of velocity. In order to achieve high propulsion efficiency with jet propulsion systems, large pumping means and large diameter nozzles must be used. Unfortunately, these manufacturers have not been able to overcome the increased hydraulic inefficiencies which develop in the large pumping means and inlet ducts which offset any gains in propulsion efficiency.

In order to maintain efficient operation of the pumping means, the flow of water therethrough must be adjusted according to the pumping means' shaft rpm. When accelerating from a constant cruising speed, the pumping means' shaft rpm will immediately increase between 35 and 60%. In order to maintain efficient operation of the pumping means, the flow of water through the inlet duct must also increase between 35 and 60%.

Heretofore, inlet ducts having variable entrance openings vary the size of their entrance openings according to the watercraft speed. For example, Toyohara, et al, (U.S. Pat. No. 5,401,198) discloses an adjustable water intake duct for a water jet propelled watercraft which adjusts the size of the intake opening according to the water pressure created in the discharged nozzle. During low speed operation, the water inlet opening is adjusted to a maximum area, to enable sufficient water to enter the water duct and permit more efficient impeller operation. As the speed of the watercraft's engine increases, the pressure inside the discharge nozzle is increased which causes the water inlet area to be reduced. By reducing the water inlet area, the drag on the watercraft is reduced.

In order to achieve maximal operating efficiency in recovering the total dynamic head of the incoming water at the pumping means, the entrance area of the inlet duct must adjusted according to match the hydraulic conditions in the inlet duct to the hydraulic conditions under the watercraft. Adjusting the entrance opening of the inlet duct based on the pressure in the discharge nozzle does not achieve this end. The invention disclosed herein discloses such an apparatus and method for achieving this end.

SUMMARY OF THE INVENTION

It is an object of the invention to provide an improved inlet duct for a marine jet propulsion system.

It is another object of the present invention to provide an inlet duct which can be used with a large pumping means and large diameter nozzle to achieve higher propulsion efficiency than currently available from marine jet propulsion systems.

It is another object of the present invention to provide an inlet duct whereby the gain in propulsion efficiency achieved when using a large pumping means and large diameter nozzle is not offset by increased hydraulic inefficiencies in the inlet duct.

It is a further object of the invention to provide such an inlet duct which can dynamically adjust to maintain efficient recovery of total dynamic head on the pumping means at all watercraft speeds and pumping means' shaft rpm.

These and other objects are met by providing an improved inlet duct for a marine jet propulsion system designed to efficiently recover the total dynamic head of the incoming water at the pumping means at all pumping means' shaft rpm and all watercraft speeds. This is especially important in marine jet propulsion systems which use a large pumping means and a large adjustable, discharge nozzle. In order to achieve this goal, the inlet duct includes a hydraulically efficient inlet tunnel with an adjustable, front entrance opening which adjusts to match the hydraulic conditions in the inlet duct to the hydraulic conditions outside the watercraft.

The hydraulically efficient inlet tunnel is longitudinally aligned in the watercraft's hull. The inlet tunnel has a front entrance opening located on the bottom of the hull and curves upward inside the hull towards a rear exit opening located immediately forward and adjacent to the pumping means. The inlet tunnel has a smooth outer surface which curves upward inside the hull with a greater cross-sectional area at its rear exit opening that gradually reduces from the aft to fore positions to a smaller cross-sectional area at its front entrance opening.

In one embodiment, a self-adjusting, articulating structure is disposed over the front entrance opening on the inlet tunnel which adjusts according to the difference in hydraulic conditions located inside the inlet tunnel and outside the watercraft. The front entrance opening on the inlet tunnel is also aligned on the inlet tunnel so that when closed, the overall length of the inlet tunnel is increased. During operation, the articulating structure adjusts according to the hydraulic conditions so that velocity of incoming water into the inlet tunnel matches the velocity of the watercraft in the body of water in which the watercraft is operated. By matching theses velocities, the total dynamic head of the incoming water will always be delivered to the pumping means operating at any shaft rpm, thus improving efficiency.

Using the above inlet duct, an improved method for delivering the total dynamic head of the incoming water to the pumping means in a marine jet propulsion system is disclosed.

DESCRIPTION OF THE PREFERRED EMBODIMENTS

Figure 1:
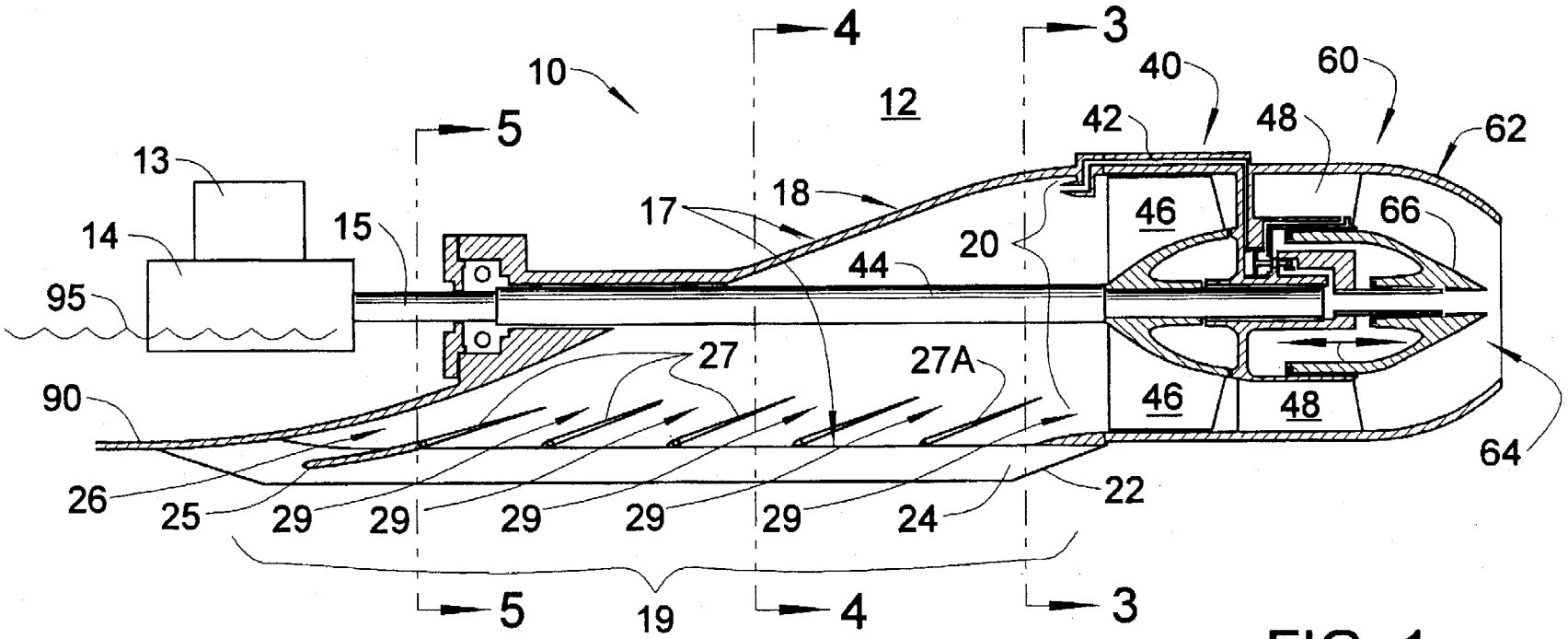
FIG. 1 is a sectional, side elevational view of a watercraft showing one embodiment of the inlet duct with a self-regulated articulating structure disposed over the front entrance opening of the inlet tunnel.

In the accompanying FIGS. 1–8, there is shown an improved marine jet propulsion system, generally referred to as 10, designed to achieve higher propulsion efficiency than currently available marine jet propulsion systems.

The system 10 includes a water inlet duct 17 for admitting water into the system 10, a large pump 40 capable of receiving and pumping a relatively large amount of incoming water, and an adjustable, large diameter discharge nozzle 60 capable of forcibly exiting the water pumped by the pump 40 to propel the watercraft through the body of water 95. By using a large pump 40 and a large diameter discharge nozzle 60, the propulsion efficiency of the system 10 is greatly improved over marine jet propulsion systems typically found in the prior art.

The inlet duct 17 which has utility with system 10 and typical marine jet propulsion systems found in the prior art is designed to efficiently recover the total dynamic head of the incoming water at the pumping means at all pumping means' shaft rpm and all watercraft speeds. The inlet duct 17 includes a longitudinally aligned inlet tunnel 18 formed or attached to the watercraft's hull. The inlet tunnel 18 is designed to draw incoming water therein for delivery to the pumping means.

It is well known in the turbine and venturi flow meter art fields that for efficient pressure recovery in an inlet duct of this type, five conditions must be met: (1) the hydraulic radius of the flow lines approaching the entrance opening of the duct must be kept large relative to the flow's cross-section in order to minimize losses due to turbulence; (2) the effective vane entrance angles must match the angle of the relative velocity vector approaching the inlet duct, commonly called the angle of approach; (3) the velocity of the fluid flowing just inside the inlet duct must match the velocity of the fluid approaching the entrance opening to the inlet duct; (4) the change in cross-sectional area between the entrance opening and exit opening of the inlet duct must be gradual and proceed at a nearly constant rate in order to minimize the formation of swirls or eddies; and, (5) the hydraulic radius within the inlet duct must be kept large relative to the flow cross-section. The inlet duct 17, disclosed herein is designed to meet these conditions.

The flow into the inlet tunnel can be conceptually divided into a plurality of partial flows, as is commonly done in the design of pumps and turbines. The first partial flow to enter the front entrance opening of the inlet tunnel 18 is located adjacent to the bottom of the watercraft's hull. After entering the front entrance opening, this partial flow continues upward and rearward to the pumping means.

It is widely known, that the flow of water through the propulsion system must equal the product of the cross-sectional area of the inlet tunnel perpendicular to the flow lines and the velocity. When the pumping means is operated at a constant rpm, its most efficient flow is also constant. Increasing the watercraft's speed, leads to increased total dynamic head recovered in the inlet duct which appears at the nozzle. If left uncorrected, the flow through the nozzle would increase which, would reduce the pumping means efficiency. To prevent this, the effective nozzle area must be reduced rate to counter the increase in total dynamic head and to maintain constant flow through the pumping means.

Figure 2:
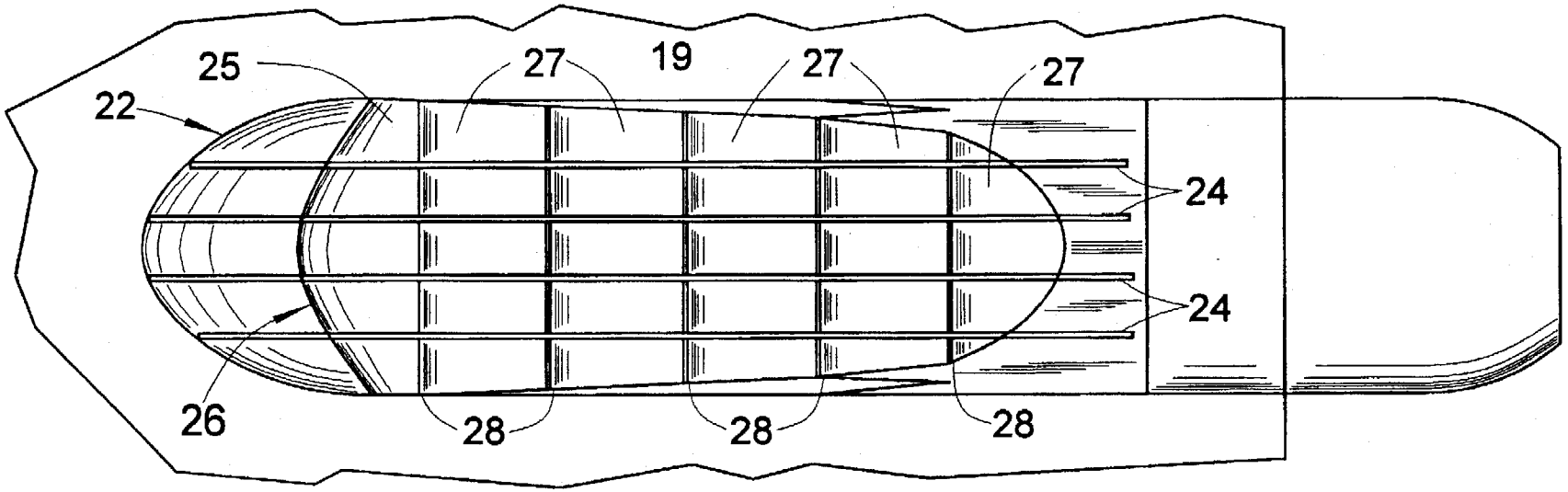
FIG. 2 is a bottom plan view of the inlet duct.
Figure 3:
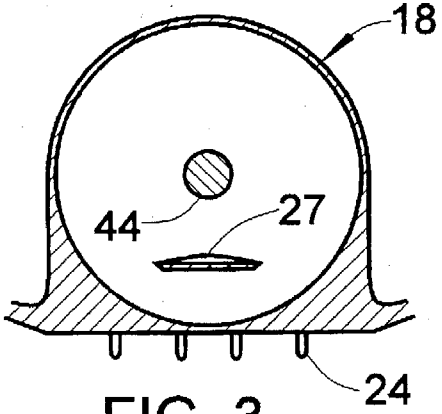
FIG. 3 is a sectional, end elevational view of the inlet tunnel region taken along line 3—3 in FIG. 1.
Figure 4:
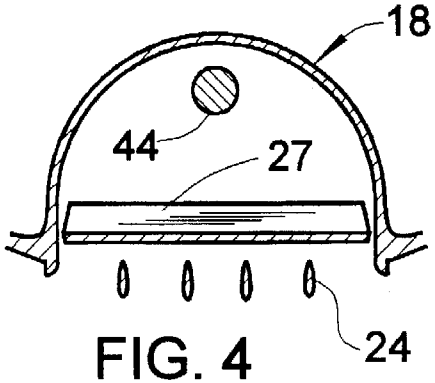
FIG. 4 is a sectional, end elevational view of the inlet tunnel region taken along line 4—4 in FIG. 1.
Figure 5:
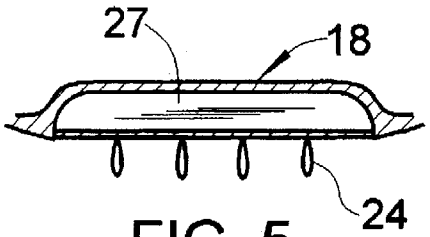
FIG. 5 is a sectional, end elevational view of the inlet tunnel region taken along line 5—5 in FIG. 1.
Figure 6:
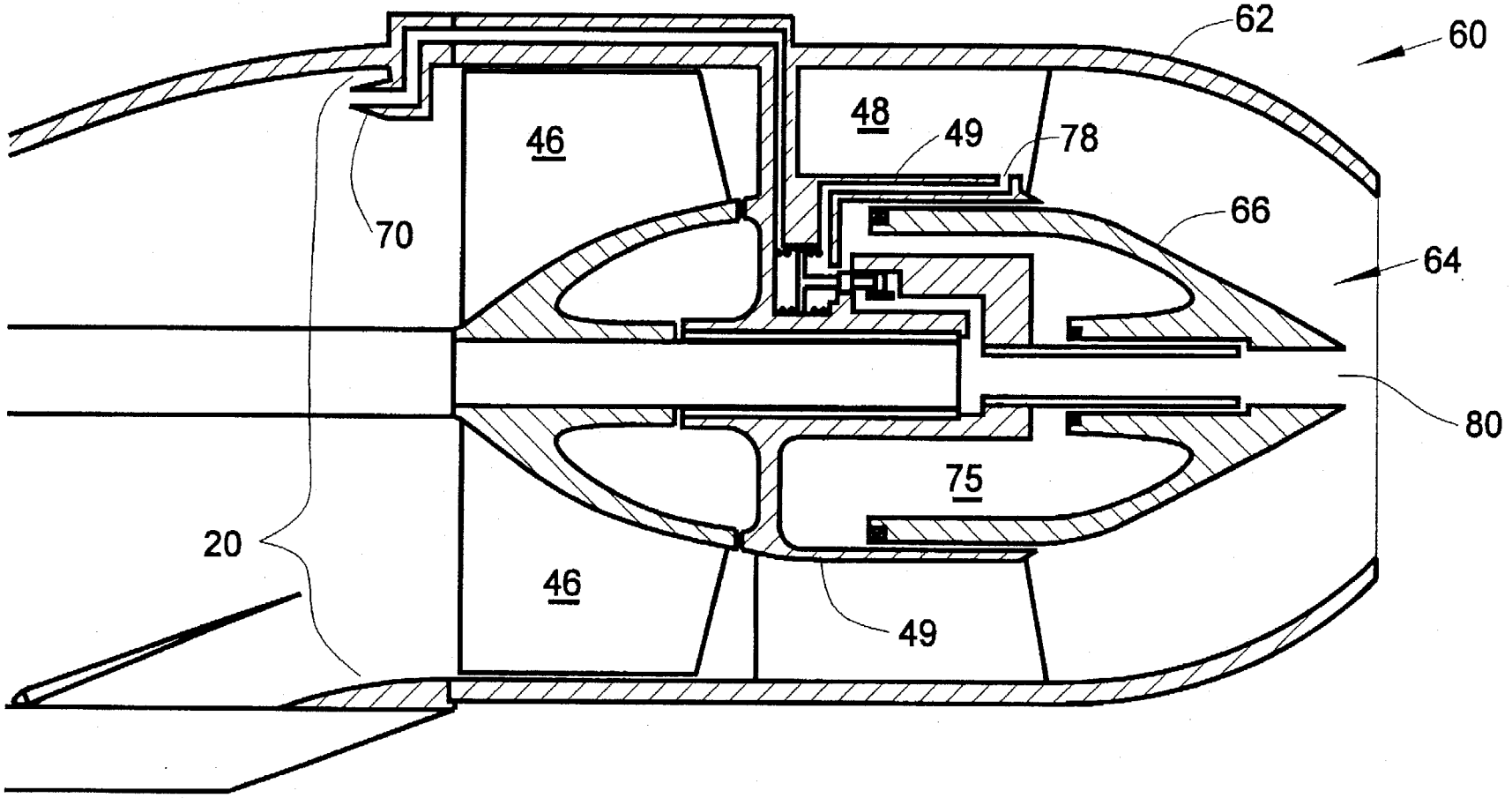
FIG. 6 is a partial, side elevational view of the system showing the needle in a retracted position in the discharge nozzle.

As shown in FIGS. 1–2, the inlet tunnel 18 is formed integrally in the hull so that the streamlines of generation along the hull forward of the inlet tunnel and bend gradually upward into the hull and continues rearward to the inlet tunnel's rear exit opening 20. Inlet tunnel 18 gently curves upward into the hull following the streamlines of flow gradually increasing in cross-sectional area from the fore to the aft positions. During use, water located along the hull is drawn upward into the inlet tunnel 18. The surface of the hull immediately adjacent to the front entrance opening 19 of the inlet tunnel 18 is tangentially curved so that turbulence is minimal.

In the first embodiment shown herein, the articulating structure 22 is self-regulating which automatically adjusts the size of the front entrance opening 19 according to the difference in hydraulic conditions inside the inlet tunnel 18 and under the hull of the watercraft. By adjusting so that the hydraulic conditions are equal, the velocity of the incoming water therethrough matches the velocity of the watercraft in the body of water 95 in which the watercraft moves. The articulating structure 22 is a grate-like structure which includes a plurality of spaced apart, longitudinally aligned elongated members 24, one transversely aligned fixed vane 25, and a plurality of spaced apart, transversely aligned floating vanes 27. A first vane opening 26 is created between the transitional region 23 of the articulating structure 22 and the fixed vane 25. The floating vanes 27 are pivotally attached along their leading edges 28 to the elongated members 24. The floating vanes 27 are spaced apart and aligned over the elongated members 24 so that an adjustable inlet openings 29 are created between adjacent floating vanes 27. The fixed and floating vanes 25, 27, respectively, are aligned so they extend upward and rearward into the inlet tunnel 18.

The leading edges of the fixed vane 25 and the floating vanes 27 span the width of the inlet tunnel 18 while the lateral edges thereof fit closely to the adjacent, inside surface of the inlet tunnel 18 in the closed position. The front and rear planar surfaces of the fixed vane 25 and the floating vanes 27 recede from the leading edge 28 to create a hydraulically effective angle. This angle follows the flow line to approximately match the velocity of approach of the flow of water entering into the inlet duct 17.

When the watercraft is stationary or at low velocity, water is drawn into through the articulating structure 22 via suction created by the pump 40. During this stage, the entrance opening 19 is wide open so that all of the floating vanes 27 conform to the streamlines of water flow and act as diffusers to reduce swirl. As the watercraft's velocity increases, water enters the articulating structure 22 by the forward movement of the watercraft thorough the body of water 95 and by the suction of the pump 40. All of the floating vanes 27 pivot freely to an opened position by aligning in a rearward, diagonally aligned position by the flow of the incoming water. During this stage, the head on the incoming water is partially recovered at the pump 40. As the watercraft increases its velocity, the entrance opening 19 begins to close as the flow lines through the articulating structure 22 become more widely spaced. The aft-most floating vane, denoted 27A, rides on the flow line until it eventually closes against the lower front edge of the pump housing 42. At this point, the leading edge of the floating vane 27A acts as the new entrance edge for the entrance opening 19 and pressure begins to build along the gradually increasing cross-sectional area between this newly created entrance opening and the pump's impeller 46.

As the velocity of the incoming water at the entrance opening 19 relative to the velocity of the incoming water at the exit opening 20 in the inlet tunnel 18 increases, the flow lines progressively closes the remaining floating vanes 27 from the aft to the fore positions. It can be seen that this has two effects— first, it reduces the effective area of the entrance opening 19; and second, it increases the effective length of the inlet duct 17. It can also be seen that the angle of approach of the streamline is always approximately aligned with the entrance angle of the vane which forms the entrance to the inlet duct 17, which is well known in the art as a design requirement for high efficiency in turbines and pumps. Further it can be seen that the changes both in cross-sectional area and in flow direction within the inlet tunnel 18 are always gradual, which are design requirements well known in the art for the efficient recovery of pressure head in turbines and venturi flow meters. By increasing the effective length of the inlet tunnel 18 and decreasing the size of the effective entrance opening 19 of the inlet duct 17, a means is provided for the efficient recovery of pressure head at every stage. The total dynamic head of the incoming water can then be recovered at the pump 40.

Figure 8:
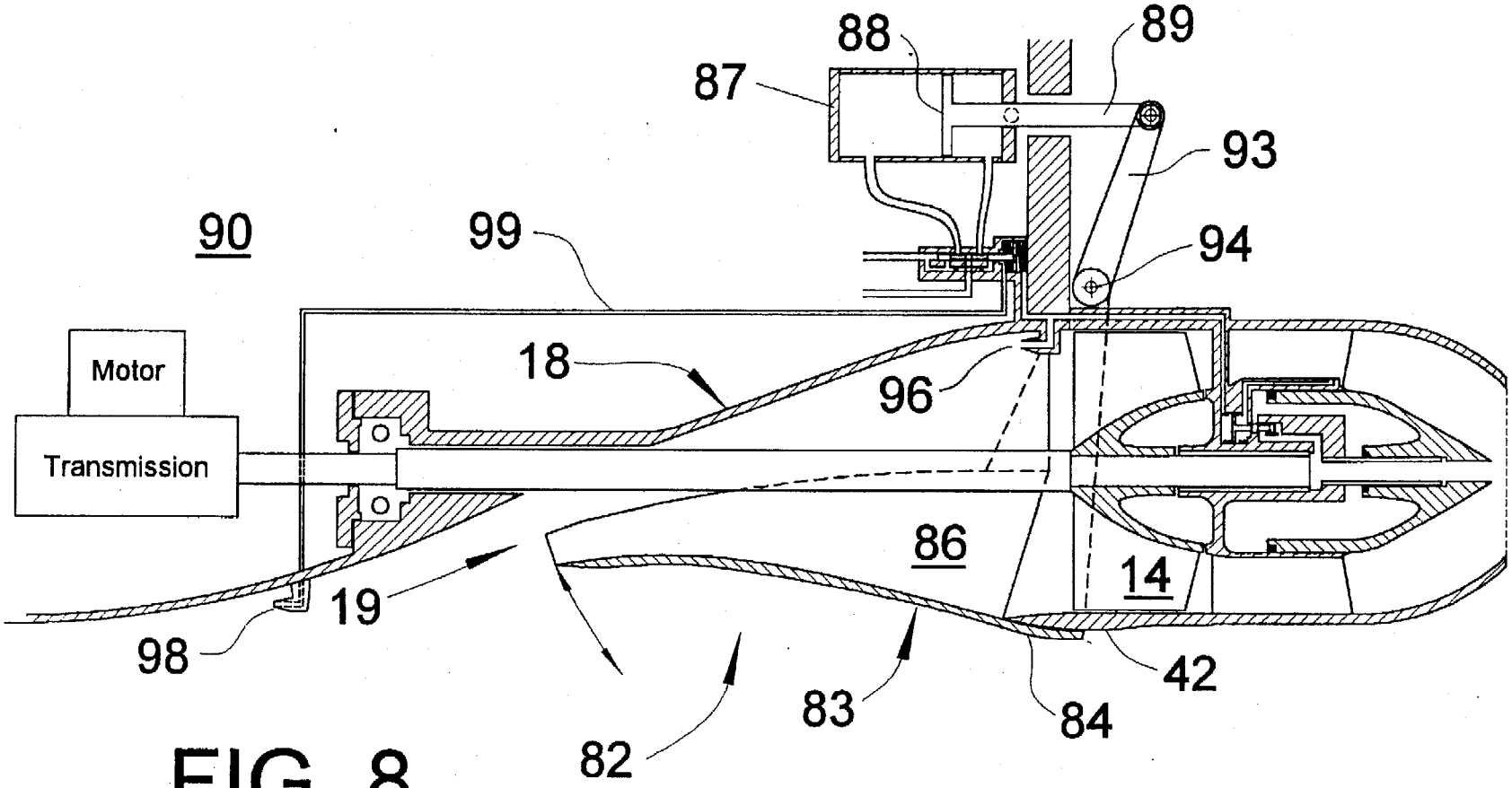
FIG. 8 is a sectional, side elevational view of a watercraft showing another embodiment of the inlet duct with an externally regulated, articulating structure disposed over the front entrance opening of the inlet tunnel.

FIG. 8 shows another embodiment of the inlet duct with an externally regulated, articulating structure 82 disposed over the front entrance opening 19 of the inlet tunnel 18. Articulating structure 82 includes an articulating planar component 83 attached to two perpendicularly aligned, side walls 86 (one shown). The upper arms of the sides wall 86 are connected to a rotating axle 94. The planar component 83 is designed to slide over its rearward section 84 on the lower, leading edge of the pump housing 42. The planar section 83 extends forward from the pump housing 42 to partially cover the front entrance opening 19 of inlet tunnel 18. The planar section 83 moves by sliding forward or rearward over the pump housing 42 and pivoting about axle 94 to close or open, respectively, the front entrance opening 19.

Movement of the planar component 83 is controlled by a hydraulic cylinder 87 located inside the hull 90. A connecting arm 93 is attached at one end to the distal end of the plunger arm 89 on the cylinder piston 88 and at its opposite end to axle 94. When the plunger arm 89 moves inward or outward from piston 88, the connecting arm 93 causes axle 94 to rotate in either counter-clockwise or clockwise directions thereby forcing the planar section 83 to move between closed and opened positions, respectively.

Figure 9:
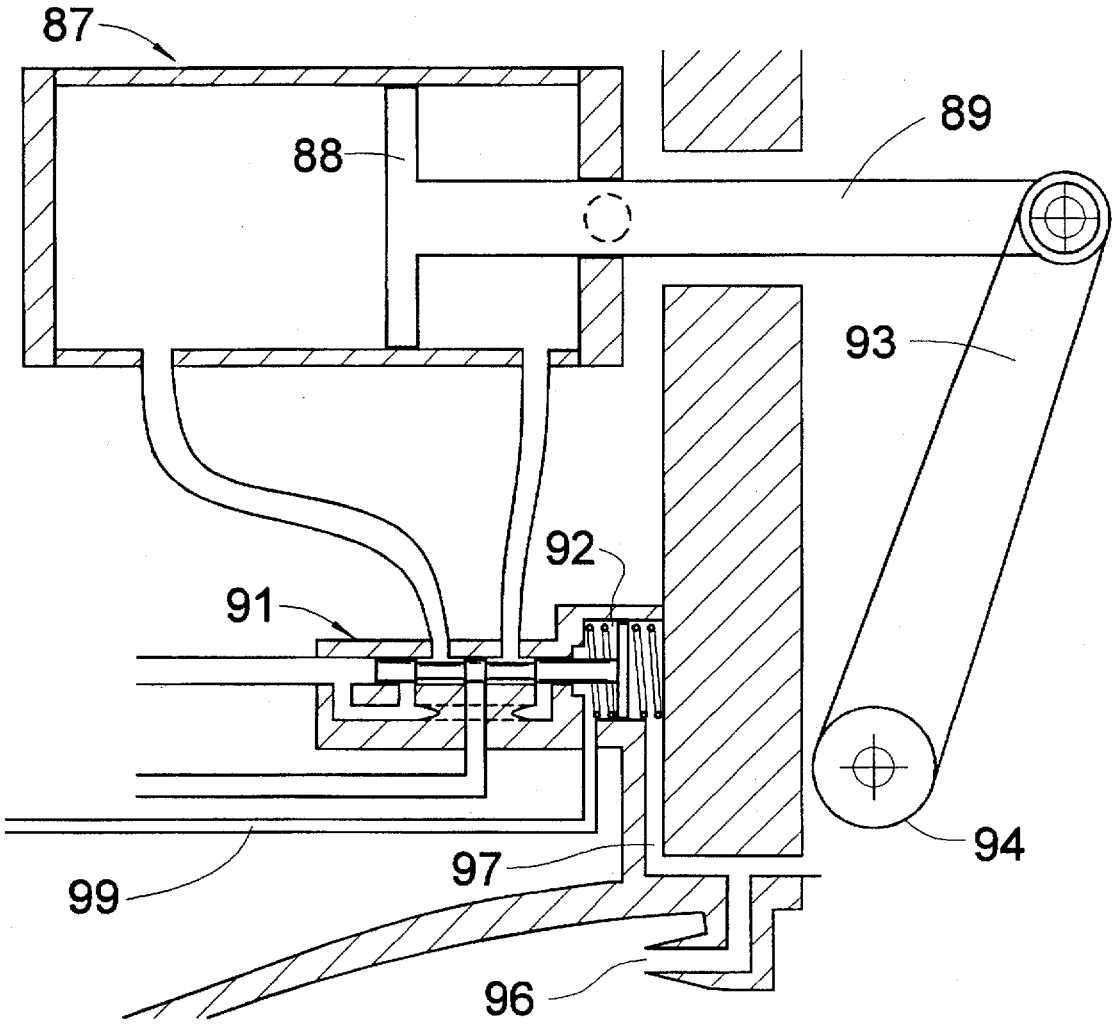
FIG. 9 is an enlarged view of the hydraulic cylinder and control valve used to control the movement of the planar component.

As shown more clearly in FIG. 9, movement of the hydraulic cylinder 87 is controlled by matching hydraulic conditions in the inlet duct 17 to hydraulic conditions under the watercraft. In the embodiment shown, a pitot tube 96 extends downward from the upper surface of the inlet tunnel 18 just ahead of the impeller 14. A conduit 97 connects the pitot tube 96 to a 4-way control valve 91. A second pitot tube 98 extends downward from the hull just ahead of the front entrance opening 19. A conduit 99 connects the pitot tube 98 to the 4-way control valve 91.

The pressure exerted on the piston 92 by water entering the pitot tube 96 is a direct measurement of the total dynamic head at the rear exit opening 20 of the inlet tunnel 18. The pressure exerted on the opposite face of the piston 92 by water entering the pitot tube 98 is a direct measure of the total dynamic head under the watercraft. The two biasing springs located in the 4-way control valve 91 are used to center the piston 92 thereby holding the cylinder 87 and planar component 83 in a fixed position.

When the total dynamic head in the inlet tunnel 18 duct exceeds approximately 95% of the total dynamic head under the watercraft, the piston 92 is displaced rearward which forces spool 88 rearward in cylinder 87. As spool 88 is displaced rearward, it applies hydraulic pressure to the cylinder by which plunger arm 89 is forced rearward which, in turn, forces axle 94 to rotate in a clockwise direction. As axle 94 rotates in a clockwise direction, the planar component 83 also rotates in a clockwise direction thereby reducing the entrance area of the front entrance opening. As the entrance area of the front entrance opening is reduced, the total dynamic head in the inlet tunnel 18 is reduced. The entrance velocity of the incoming water is also increased and the entrance pressure is reduced.

When the total dynamic head in the inlet tunnel 18 duct falls below approximately 95% of the total dynamic head under the watercraft, the piston 92 is displaced forward which forces spool 88 forward in cylinder 87. As spool 92 is displaced forward, plunger arm 89 is forced forward which, in turn, forces axle 94 to rotate in a counter-clockwise direction, the planar component 83 also rotates in a counter-clockwise direction thereby increasing the entrance area of the front entrance opening. As the entrance area of the front entrance opening is increased, the total dynamic head in the inlet tunnel 18 is reduced. The entrance velocity of the incoming water is also reduced and the entrance pressure is increased.

It should be understood that the pitot tube 96 can be located at any position inside the inlet tunnel 18 downstream from the front entrance opening 19, because the total dynamic head changes very little along an efficient duct.

In addition, it should be understood that the pitot tubes 96, 98 can be replaced with simple pressure ports. If so, the pressure port which replaces pitot tube 96 must be located just inside the front entrance opening 19, because velocity head is converted to pressure head along the duct.

It should also be understood that the three hydraulic conditions which must be maintained nearly constant from under the boat into the duct entrance are velocity, pressure and total dynamic head, and that maintaining any one of these conditions is a necessary and sufficient condition for maintaining the other two. The embodiment of FIG. 1 matches the velocities, the embodiment of FIGS. 8 and 9 matches the total dynamic heads, and the use of pressure ports with FIGS. 8 and 9 as described above matches the pressures. Each of these devices is in fact fully effective in matching all three hydraulic conditions; velocity, pressure and total dynamic head between the duct entrance and the approaching water flow.

In the preferred embodiment, a 200 h.p., axially aligned pump 40, as described below, is used. With this size of pump 40, the diameter of the discharge nozzle 60 must be 7.7 inches to achieve a watercraft velocity of 35 feet per second and below. When the pump 40 is accelerated, the mass flow of the incoming water and the head on the pump 40 must be held constant by reducing the diameter of the discharge nozzle 60. For example, when the watercraft is operated at a velocity of 80 feet per second, the diameter of the discharge nozzle 60 must be reduced to 6.5 inches.

In order to maintain optimal efficiency in recovering total dynamic head of the oncoming water at the pump 40, the area of the entrance opening 19 of the inlet duct 17 must be adjusted so that the flow of incoming water matches the watercraft's velocity in the body of water. With this particular pump 40 and effective discharge nozzle size, the minimum cross-sectional area of the entrance area of the inlet duct to achieve a watercraft velocity of 80 feet per second is approximately 41 square inches. At a watercraft velocity of 35 feet per second, the cross-sectional area of the entrance opening 19 of the inlet duct 17 must be increased to approximately 94 square inches.

Below a watercraft velocity of 35 feet per second, the discharge nozzle 60 does not open further and the flow of water through the system is reduced. At a watercraft velocity of 15 feet per second, the flow of water is 1,350 pounds per second which requires an entrance opening 19 having a cross-sectional area of approximately 202 square inches. At a watercraft velocity of 20 feet per second, the flow of water is 1,375 pounds per second which requires an entrance opening of 154 inches.

In the pump 40, a 14 inch diameter impeller is used which rotates in an opening having a cross-sectional area of 154 square inches. In the preferred embodiment, the inlet tunnel 18 is efficiently transitioned to the hull by generating curves tangent to the flow lines along the surface of the hull. This has the effect of flaring out the upper two quadrants of the circle as the inlet tunnel 18 proceeds in a forward direction until these two quadrants are substantially square at the entrance opening. By flaring the inlet tunnel 18 is this manner, the total cross-sectional area of the entrance opening 19 is increased as much as 42 square inches thereby making the total cross-sectional area of the entrance opening 19 to 196 square inches. This approaches the cross-sectional area of 202 square inches required for efficient recovery by the pump 40 when the watercraft velocity is 15 feet per second.

Disposed adjacent to the exit opening 20 of the inlet tunnel 18 is the pump 40 which is coupled via a transmission 14 to an engine 13. In the embodiment shown, the pump 40 is contained in a pump housing 42 attached to or formed integrally with the inlet tunnel 18. The pump 40 is axially aligned with the exit opening 20 so that the pump shaft 44 extends forward therefrom and connects to the transmission 14. In the embodiment shown, the pump 40 includes an impeller 46 which rotates to forcibly deliver the incoming water from the exit opening 20 to the discharge nozzle 60 located on the opposite side of the pump 40. The size of the pump 40 is determined by the size of the discharge nozzle and the type and size of watercraft. The size of the pump 40 is limited by the space in the watercraft and the production costs. In the preferred embodiment, the pump 40 is designed to be used with a 200 horsepower engine so that the mass flow equals approximately 1500 lbs/sec and the pump head is approximately 57 feet. The pump 40 uses a 14 inch impeller 46 which matches the size of the outer housing 62 on the discharge nozzle 60 designed to form a 7½ inch effective nozzle opening 64. A diffuser 48 is disposed over the aft position of the pump 40 to recover the forced vortex produced by the pump 40.

The 14 inch impeller 46 must operate at about 2070 RPM to meet the head and flow requirements of the discharge nozzle. Unfortunately, this is too fast to avoid cavitation at low watercraft speeds with partial recovery of incoming dynamic head. This size of impeller 46 is able to operate close to full power, however, once the effective submergence reaches 14 feet at 30 FPS (20 mph). The impeller 46 is still cavitating under these conditions, and this cavitation would destroy the impeller 46 in a few months of continuous service, but it has very little effect on efficiency. The fact that the impeller 46 cavitates at speeds below 20 mph at full power, is balanced by the transient nature of that service.

Located at the aft position to the pump's diffuser 48 is the discharge nozzle 60 which includes an outer nozzle housing 62 with a retractable needle 66 disposed therein. The needle 66 is longitudinally aligned inside the diffuser's hub 49 and moves axially therein to adjust the size of the effective nozzle opening 64.

A nozzle adjustment means is connected to the discharge nozzle 60 for controlling the size of the effective nozzle opening 64, and hence the rate of flow of water through the system 10. As shown in FIGS. 6 and 7(A)–(C), the nozzle adjustment means includes a pitot tube 70, a pressure conduit 72, a spool control valve 74 and inner chamber 75 disposed between the needle 66 and the hub 49. The port opening on the pitot tube 70 is disposed in a fore position to the pump's impeller 46 and is connected to the spool control valve 74 via the pressure conduit 72. The spool control valve 74 includes a piston 76 disposed inside a small inner cylinder 77 located in the hub 49. The operation of the nozzle adjustment means to control the flow of water through the system 10 is discussed further below.

The efficiency of the marine jet propulsion system is the product of three components, inlet duct, pump and nozzle. The last can be taken as a constant of about 97%, leaving only duct and pump efficiency as design considerations. The two are independent in that duct efficiency does not affect pump efficiency and pump efficiency does not affect duct efficiency. Both affect system efficiency. However, the flow variations caused by the inlet duct recovery of head result in inefficient pump operation, if the flow is not corrected by nozzle area adjustments.

The head on the nozzle is the sum of the pump head and the inlet duct head. The flow through the nozzle increases as the effective area of the nozzle increases and as the square root of the head on the nozzle increases. If the flow increases due to increased head, it can be reduced by reducing the nozzle area. This is useful, because the flow must be constant for any given shaft rpm to maintain pump efficiency. For example, pump efficiency at full power shaft rpm requires the same flow, regardless of the head recovered in the inlet duct, which can be seen in the following.

The efficiency of the pump is a function of flow and shaft rpm. According to the widely used pump affinity relationships for any and all pumps, the best efficiency is obtained when flow Q divided by rpm N equals the constant characteristic of the pump design ($Q/N=K_Q$).

A pump's operating efficiency point has three coordinates: rpm N, flow Q and head h. Any two determine the third. In this discussion, the pump's best efficiency operating point is the particular operating point of interest. The determining affinity equations are $Q=K_Q N$ and $h=K_h N^2$, wherein $K_h$ is the head constant characteristic of the pump design. From the above, it is quickly apparent from substitution that $h=K_h (Q/K_Q)^2$. When this hydraulic condition is met, the pump is operating at its best efficiency.

OPERATION OF THE INVENTION

When the watercraft is stationary or moving at very low speed, no pressure is recovered in the inlet duct 17 and the pump 40 is operating in a suction mode. All of the floating vanes 27 in the inlet duct 17 are in an open position and act to diffuse the flow of water therein. The balance of forces moves the piston 76 to the forward position. The needle 66 is fully retracted in the outer housing 62. The effective nozzle opening 64 is then at a maximum. The pump's impeller 46 and discharge nozzle 60 are designed so that the pump 40 operates at less than peak efficiency flow under this condition. This nozzle restriction reduces both the flow and the hydraulic efficiency of the pump 40, which produces higher head and demands more power from the engine 13. The power is readily available because the engine 13 can supply substantial power in excess of the cavitation limit of the pump 40. Part of the power that would have been consumed during cavitation is lost to the lower hydraulic efficiency of the pump 40, but the reduced-flow operation has the net effect of maximizing the hydraulic power delivered by the pump 40 to the discharge nozzle 62. As a result, the smaller effective nozzle opening produces greater thrust than would be produced by a larger effective nozzle opening, which would be required to maintain the pump's peak hydraulic efficiency in the absence of cavitation.

As the water craft's speed increases, the inlet duct 17 recovers part of the available dynamic head and becomes fully effective when the velocity of the watercraft reaches approximately 30 feet per second (20 mph). At this boat speed, the velocity of the water entering the inlet duct 17 matches the velocity of the watercraft in the body of water. This boat speed is typically the peak hull drag at its greatest wave making losses as the watercraft is coming up on plane. At this velocity, the inlet duct 17 recovers about 14 feet of total dynamic head at the pump's impeller 46. This head is effective submergence of the pump 40 and acts to suppress cavitation. The 14 feet of total dynamic head is also additive to the pump head at the nozzle, increasing flow to that required for the pump's most efficient operation, such operation no longer limited by cavitation under said 14 feet of effective submergence. These hydraulic conditions allow full power operation without significant cavitation losses. The inlet duct 17, the pump 40, and the discharge nozzle 60 are now operating at maximum efficiency at any shaft power up to full design power.

The total dynamic head of the incoming water in the inlet tunnel 18 at the exit opening 20 is converted to pressure in the pitot tube 70, as is well known in the art. This pressure acts through the pressure conduit 72 on the piston 76 in the spool control valve 74 to produce a motive force. The pressure component of the total dynamic head after the pump 40 is then delivered through the pressure port 78 on the hub 49 which creates a motive force on the inside surface of the piston 76 located in the inner chamber 77. The design is such that these two forces exerted on the piston 76 are in balance whenever the pump 40 is operating at best efficiency.

Figure 7A:
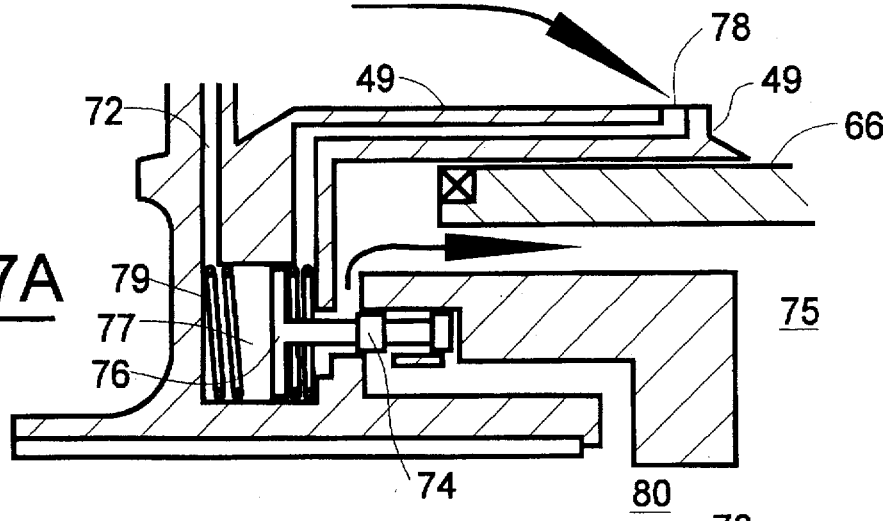
FIGS. 7(A)–(C) are illustrations showing the movement of the needle in response to the fluid flow around the needle and the chamber.
Figure 7B:
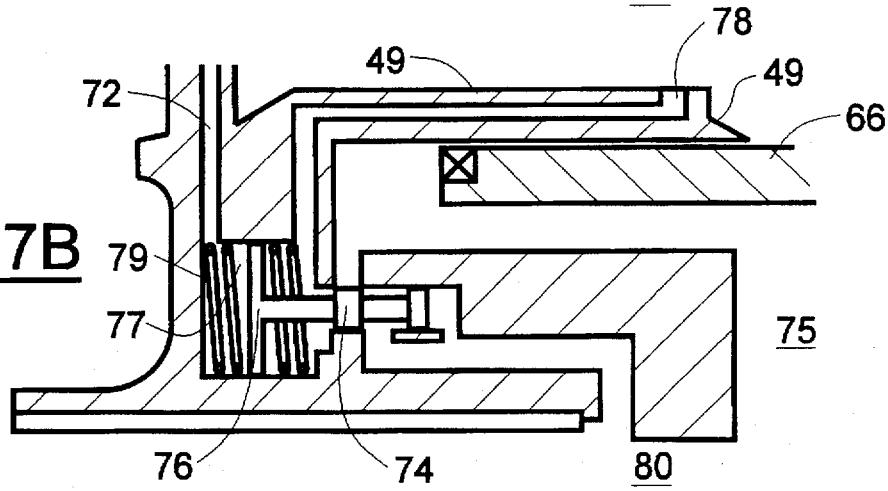

If the flow f(1) is too high for the head being produced by the pump 40, the net motive force on the piston 76 moves the spool control valve 74 to allow water from the pressure port 78 to flow from the piston chamber 77 and into the needle's inner chamber 75, which advances the needle 66, as shown in FIG. 7A. This, of course, reduces the effective area of the nozzle opening 64 and reduces the flow therethrough. With the reduction of flow through the nozzle opening 64, the forces exerted on the opposite sides of the piston 76 are balanced which, in turn, causes the spool control valve 74 to move back into a neutral position so that no water flows either into or out of the piston chamber 75 as shown in FIG. 7B. A biasing spring 79 disposed inside the piston chamber 77 is used to make the spool control valve 74 movement proportional to the net motive force on the piston 76, and this provides stable operation, as is well known in the art.

Figure 7C:
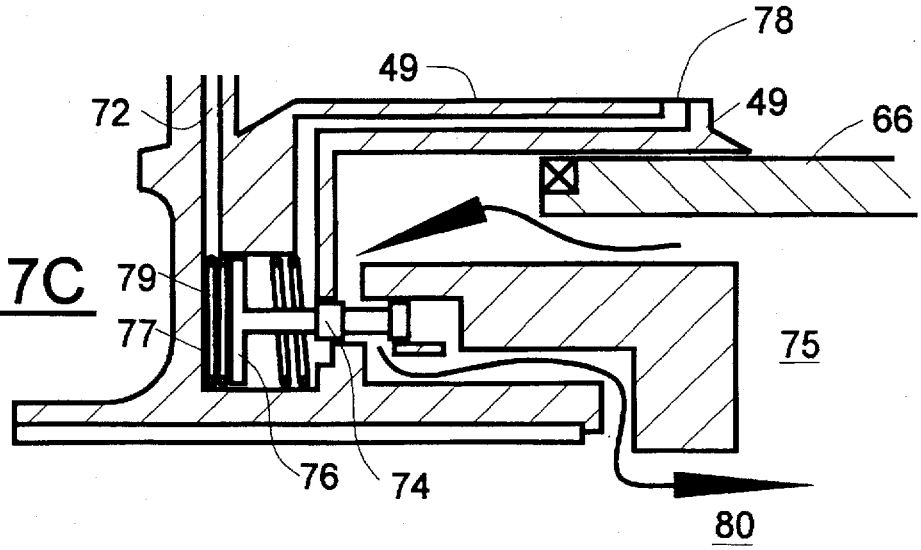

If the flow f(1) is two low, the net motive force on the piston 76 acts to move the spool control valve 74 in a forward direction, which compresses the biasing spring 79 as shown in FIG. 7C. When sufficient force is exerted on the piston 76, the spool control valve 74 opens the piston chamber 77 to the drain 80, thereby allowing the water in the piston chamber 77 to flow f(5) into the drain 80. The pressure in the outer housing 62 acts against the outer face of the needle 66 to force the needle 66 longitudinally back into the hub 49. This movement forces the water from the inner chamber 75 and into the drain 80. As the needle 66 retracts, the effective nozzle opening 64, and hence the flow f(1), increases until the motive force on the piston 76 and biasing spring 79 again returns the spool control valve 74 to its neutral position as shown in FIG. 7B.

As one can see, the needle 66 adjusts so that the pump 40 operates at its optimal efficiency, regardless of the total dynamic head in the inlet duct 17 or the shaft power. Similarly, the inlet duct 17 can be seen to effectively recover the total dynamic head at any watercraft speed greater than the design minimum and any pump shaft power less than the design maximum, because the effective area of entrance opening area of the inlet duct 17 must be reduced with either higher velocity or lower power.

As mentioned above, the floating vanes 27 on the inlet duct 17 ride on the flow lines of the water flow field in the inlet duct 17. Such flow fields, composed of stream lines and pressure isobars perpendicular thereto, are well known in the art of pump and turbine designs. In the absence of the floating vanes 27, the flow of water into the middle of the inlet duct 17 would be rejected out of the back of the inlet duct 17 and this loss of flow could be seen to increase with increased velocity of the watercraft and decrease the inlet duct's recovery of pressure. This outflow at the back of the inlet duct 17 is the major source of inlet duct inefficiency in the prior art.

In the invention disclosed herein, the anterior floating vane 27A prevents this outflow when the flow line carries it up against the articulating structure 22 which prevents it from releasing the flow. The flow, thus trapped above the anterior floating vane 27A, acts fully against the impeller 46, and the inlet duct 17 is now defined by the leading edge of the aft vane, denoted 27A. It can be seen that the area of the inlet duct 17 is effectively reduced by the closing of this vane, because its leading edge forms a smaller duct opening than does its trailing edge due to the incline geometry of the inlet duct.

As the watercraft approaches top speed at the full power required to overcome hull drag, all of the floating vanes 27 in the inlet duct 17 are closed by the flow across the cross-section area of the first inlet opening 26, which becomes the total system flow at the relative velocity of the water across the area of the fixed inlet.

At top speed, it can also be seen that the needle 66 will be fully extended to reduce the effective nozzle opening 64, because this speed produces the greatest pressure recovery in the inlet duct 17.

In the preferred embodiment discussed above, the system 10 can also be seen to operate efficiently at the water craft's lowest planing velocity of approximately 45 feet per second. At this velocity, the inlet duct 17 recovers approximately 30 feet of total dynamic head at the pump's impeller 46. With the reduced hull drag at the typical hull's most efficient planing velocity, the required pump shaft power is reduced to approximately 25% of maximum. The low shaft power at this watercraft velocity requires reduction of flow for efficient pump operation, and the needle 66 is fully extended to reduce the effective nozzle opening 64. The pump 40 is operating under conditions which are suitable for long term commercial operation in accordance with the standards of the Pump Institute. Commercial pumps of this size commonly achieve efficiencies in the range of 85–89% under these conditions.

If the shaft power is increased rapidly to full power, the effective nozzle opening 64 will increase to allow the higher flow required by the pump 40 at the higher shaft power. The rate of change is limited by the flow from the piston chamber 75 to the drain 80 via the spool control valve 74. The inertia of the engine and transmission limit the rate of change of the shaft speed, and the increased nozzle pressure caused by a lag in the needle 66 response acts to increase the rate of correction, both of which are natural stabilizing effects to the control response. The inlet duct 17 will independently open to supply the greater system flow and will still recover the same 30 feet of total dynamic head against the impeller 46, except that the velocity component will be higher and the pressure component correspondingly lower.

From this, it can be seen that the inlet duct 17 and the discharge nozzle 62 are able to simultaneously maintain efficient recovery of the power in the relative velocity of the water, efficient operation of the pump 40, and high propulsion efficiency characteristic of the large nozzle over all velocities above 30 fps and over all pump shaft power levels above what is required to overcome hull drag.

It can also be seen that the combined use of the inlet duct 17 and the discharge nozzle 60 require a larger range of action in each than would be required if the inlet duct 17 or discharge nozzle 60 were used singularly. For example, the entrance area of the inlet duct 17 must be largest at low watercraft velocities when the effective nozzle opening 64 is at its maximum setting. The entrance area of the inlet duct 17 must be smallest at high watercraft velocities and when the effective nozzle opening 64 is at its minimum setting.

In compliance with the statute, the invention, described herein, has been described in language more or less specific as to structural features. It should be understood, however, the invention is not limited to the specific features shown, since the means and construction shown comprised only the preferred embodiments for putting the invention into effect. The invention is, therefore, claimed in any of its forms or modifications within the legitimate and valid scope of the amended claims, appropriately interpreted in accordance with the doctrine of equivalents.

I claim:

1. An improved inlet duct for a marine jet propulsion system for a watercraft which includes a hull with an inlet duct, a pump, and a discharge nozzle located therein, said inlet duct comprising:

a) a hydraulically efficient inlet tunnel formed on said hull of the watercraft, said inlet tunnel having a front entrance opening and a rear exit opening, said inlet tunnel having an outer shape which gradually increases in cross-sectional area perpendicular to the streamlines of flow therethrough from said front entrance opening to said rear exit opening; and, b) an articulating structure attached over said front entrance opening of said inlet tunnel, said articulating structure capable of adjusting in size according to the difference in hydraulic conditions located in said inlet tunnel under the hull so that incoming water flowing through said front entrance opening of said inlet tunnel matches the velocity of the watercraft in the body of water.

2. An improved inlet duct as recited in claim 1, wherein said inlet tunnel curves upward and smoothly into the hull, said front entrance opening on said inlet tunnel being tangentially curved to follow stream lines of generation.

3. An improved inlet duct as recited in claim 2, wherein said articulating structure is self-regulated.

4. An improved inlet duct as recited in claim 2, wherein said articulating structure is externally regulated.

5. An improved inlet duct as recited in claim 4, wherein said articulating structure is a planar component capable of moving to open and closed said front entrance opening on said inlet tunnel, said planar component including an external control means which moves said planar component between open and closed positions according to the differential in hydraulic conditions inside the inlet tunnel and under the hull.

6. An improved inlet duct as recited in claim 5 wherein said differential in hydraulic conditions is between the pressure produced in a pitot tube inside said inlet tunnel and a pitot tube under the watercraft.

7. An improved inlet duct for a marine jet propulsion system for a watercraft which includes an inlet duct, a pump, and a discharge nozzle, said inlet duct comprising:

a) a hydraulically efficient inlet tunnel formed in the hull of the watercraft, said inlet tunnel having a front entrance opening and a rear exit opening with said inlet tunnel being formed by stream lines of generation which commence at said front entrance opening and curve upward to progressively draw water into said inlet tunnel and towards said exit opening; and, b) an articulating structure attached over said front entrance opening of said inlet tunnel, said articulating structure capable of self-adjusting to control the areas across which water that enters said inlet tunnel so that the velocity of water flowing therethrough matches the velocity of the watercraft in the body of water.

8. A method of delivering the dynamic head required by a marine jet propulsion system for a watercraft which includes a pumping means and a discharge nozzle, said pumping means capable of receiving incoming water and forcibly delivering the incoming water to a discharge nozzle and exit therethrough to propel the watercraft through a body of water, said method including the following steps:

a) selecting a watercraft having an inlet duct capable of delivering the total dynamic head of incoming water to said pumping means, said inlet duct including a hydraulically efficient inlet tunnel and an articulating structure attached over the front entrance thereof, said inlet tunnel being shaped so that cross-sectional area progressively increases from the fore to the aft positions, said articulating structure capable of adjusting according to the difference in hydraulic conditions located inside said inlet tunnel and outside said watercraft so that the velocity of incoming water into said inlet tunnel matches the velocity of the watercraft; and, b) operating said watercraft in said body of water.

9. An improved inlet duct for a marine jet propulsion system for a watercraft which includes a hull with an inlet duct, a pump, and a discharge nozzle located therein, said inlet duct comprising:

a) a hydraulically efficient inlet tunnel formed on said hull of the watercraft, said inlet tunnel having a front entrance opening and a rear exit opening, said inlet tunnel curving upward and smoothly into the hull, said front entrance opening on said inlet tunnel being tangentially curved to follow stream lines of generation, said inlet tunnel further having an outer shape which gradually increases in cross-sectional area perpendicular to the streamlines of flow therethrough from said front entrance opening to said rear exit opening; and, b) a self-regulated articulating structure attached over said front entrance opening of said inlet tunnel, said articulating structure capable of adjusting in size according to the difference in hydraulic conditions located in said inlet tunnel under the hull so that the velocity of the incoming water flowing through said front entrance opening of said inlet tunnel matches the velocity of the watercraft in the body of water, said articulating structure including a plurality of transversely aligned floating vanes, each said floating vane being pivotally attached to enable said floating vane to move according to the flow of water entering said inlet duct, thereby reducing the size of said entrance opening and increasing the length of said inlet tunnel.

10. An improved inlet duct for a marine jet propulsion system for a watercraft which includes an inlet duct, a pump, and a discharge nozzle, said inlet duct comprising:

a) a hydraulically efficient inlet tunnel formed in the hull of the watercraft, said inlet tunnel having a front entrance opening and a rear exit opening with said inlet tunnel being formed by stream lines of generation which commence at said front entrance opening and curve upward to progressively draw water into said inlet tunnel and towards said exit opening; and, b) an articulating structure attached over said front entrance opening of said inlet tunnel, said articulating structure capable of self-adjusting to control the areas across which water enters said inlet tunnel so that the velocity of water flowing therethrough matches the velocity of the watercraft in the body of water, said articulating structure including at least one transversely aligned fixed vane and a plurality of transversely aligned floating vanes, each said floating vane being pivotally attached to enable said floating vane to move according to the hydraulic conditions thereon, thereby adjusting the size of said entrance opening and the length of said inlet tunnel according to the hydraulic conditions.

11. A watercraft, comprising:

a hull having an inlet duct, a pump, and a discharge nozzle located therein, the inlet duct including:

a hydraulically efficient inlet tunnel for flow of water therethrough, the inlet tunnel being formed on said hull of the watercraft, the inlet tunnel having a front entrance opening and a rear exit opening, and the inlet tunnel having an outer shape which gradually increases in cross-sectional area perpendicular to the streamlines of flow therethrough from said front entrance opening to said rear exit opening; and an articulating structure attached over said front entrance opening of said inlet tunnel, said articulating structure being adjustable in size according to the hydraulic conditions in said inlet tunnel so that the velocity of the water flowing through said front entrance opening of said inlet tunnel matches the velocity of the watercraft in the body of water.

* * * * *